US005535904A

United States Patent [19]

Tucker

[11] Patent Number: 5,535,904

[45] Date of Patent: Jul. 16, 1996

[54] SURFACE PREPARATION FOR BONDING IRON

[75] Inventor: Wayne C. Tucker, Exeter, R.I.

[73] Assignee: The United States of America as represented by the Secretary of the Navy, Washington, D.C.

[21] Appl. No.: 381,592

[22] Filed: Jan. 25, 1995

[51] Int. Cl.[6] ..... B44C 1/22; C23F 1/00

[52] U.S. Cl. ..... 216/35; 216/52; 216/100; 252/79.2; 252/79.4

[58] Field of Search ..... 216/34, 35, 52, 216/100; 252/79.2, 79.4; 134/3, 41

[56] References Cited

U.S. PATENT DOCUMENTS 4,610,759 9/1986 Klages ..... 252/79.2

*Primary Examiner*—William Powell

*Attorney, Agent, or Firm*—Michael J. McGowan; Prithvi C. Lall; Michael F. Oglo

[57] ABSTRACT

The present invention relates to an improved etchant for iron materials and a method for etching iron materials. The etchant is an aqueous solution of ferrous chloride and phosphoric acid. The etchant preferably consisting of essentially of 20.6 gm $FeCl_2 \cdot 4H_2O$, 88 ml $H_3PO_4$ (concentrated 85%) and deionized water sufficient to make a 500 ml solution total. The method of etching includes the steps of preparing the surface of the iron material to be etched by degreasing and abrading the surface and etching the surface by immersing the iron material in the ferrous chloride and phosphoric acid solution. After the surface has been completely dried, an epoxy material may be bonded thereto. The method and etchant of the present invention provide an iron surface which bonds well with an epoxy, but does not destroy any existing epoxy bond in the material as would be present in a wound iron core material bonded with an epoxy cement.

10 Claims, No Drawings

SURFACE PREPARATION FOR BONDING IRON

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

1. Field of the Invention

The present invention relates to a method for etching iron and iron alloy materials and an etchant for use therein. More particularly, the method and etchant of the present invention aggressively etch an iron material previously wound and bonded with epoxy cement without destroying any existing epoxy bond in the material.

2. Description of Prior Art

Metallic materials are exposed to etching treatments for a variety of purposes. For example, a metallic material such as aluminum may be subjected to an etching treatment before it is bonded to a fluorocarbon resin. U.S. Pat. No. 3,115,419 to Dale illustrates such a method wherein aluminum materials are subjected to an etching treatment using an etchant comprising an aqueous solution of either acetic acid, sodium chloride, cupric chloride and water or trichloracetic acid, ferric chloride, chloroplatinic acid and water.

Etchants may also be used as part of a method for producing an electrically conductive pattern. U.S. Pat. No. 4,093,504 to Ponjee et al. illustrates such a method wherein an electrically conductive pattern is formed by forming a uniform layer of indium oxide on an electrically insulating support, applying to said indium oxide layer an etch-resistant coating in the negative image of the desired pattern, and applying to said thus coated layer an aqueous hydrochloric acid etching solution containing in addition to the acid, ferric chloride in a quantity between 0.01 mol/l and the saturation concentration thereof. U.S. Pat. No. 5,185,059 to Nishida et al. illustrates a similar process wherein an etchant of hydroiodic acid or a hydroiodic acid-ferric chloride aqueous solution mixture is used to leave an indium-tin-oxide electrode pattern.

Still further, metal surfaces may be etched prior to having a coating such as polytetrafluoroethylene applied thereto. U.S. Pat. No. 5,185,057 to Playdon illustrates an etching process wherein a solution containing ferric chloride and phosphoric acid is applied to a metal surface to be coated. During this etching process, an effective concentration of ferric ions is maintained by diffusing an oxidizing agent which is chlorine gas or a compound which forms HOCl in solution through the etching tank.

Generally accepted practice for etching ferrous alloys involves concentrated orthophosphoric acid or concentrated hydrochloric acid. However, many motor parts in use today consist of a wound iron core material bonded with epoxy cement. The use of concentrated orthophosphoric or hydrochloric acid etchants on these parts has resulted in damage to the epoxy cement bonded to the iron materials.

Thus, there is a need for an etchant which yields an iron surface that bonds well to a coating material, such as an epoxy material, but does not destroy the existing epoxy cement or material already bonded to the iron material.

SUMMARY OF THE INVENTION

Accordingly, it is a principal object of the present invention to provide an improved etchant for etching an iron material which etchant does not destroy existing epoxy materials bonded to the iron material.

It is a further object of the present invention to provide an improved etchant as above which facilitates the formation of high strength bonds to coating materials.

It is yet a further object of the present invention to provide an improved method for etching iron materials.

Still further objects and advantages will become apparent from the following description.

In accordance with the present invention, the improved etchant for etching iron materials, particularly iron materials previously wound and bonded with epoxy cement, comprises an aqueous solution of ferrous chloride and phosphoric acid. In a preferred embodiment, the etchant of the present invention comprises an aqueous solution consisting essentially of 20.6 gm $FeCl_2 \cdot 4H_2O$, 88 ml $H_3PO_4$ (concentrated 85%) and the balance sufficient deionized water to make 500 ml total of said solution.

The etching method of the present invention comprises degreasing and abrading the surface to be etched, etching the surface in the ferrous chloride and phosphoric acid solution, and drying the etched surface. After the surface has been completely dried, an epoxy material may be bonded thereto.

DESCRIPTION OF THE PREFERRED EMBODIMENT

As previously discussed, the present invention relates to an etchant for etching iron materials and a method for etching iron materials. As used herein, the term "iron materials" includes pure iron materials and iron alloy materials. The etchant of the present invention has particular utility in etching iron materials previously wound and bonded with epoxy cement.

An etchant in accordance with the present invention comprises an aqueous solution containing ferrous chloride and phosphoric acid. In a preferred embodiment, the etchant comprises an aqueous solution consisting essentially of 20.6 gm $FeCl_2 \cdot 4H_2O$, 88 ml. $H_3PO_4$ (concentrated 85%), and the balance sufficient deionized water to make 500 mls of solution. It has been found that this etchant is quite beneficial in that one can etch iron materials such as motor parts wherein the iron is bonded to epoxy material without destroying or damaging the existing epoxy material or the bonds between the iron material and the epoxy material.

In accordance with the present invention, the method of etching iron materials is as follows. The surface of the iron material to be etched is first degreased such as by applying isopropyl alcohol and thereafter abraded. The abrading step may be performed using 80 grit wet abrasive paper. The abrading step is preferably carried out until the surface to be etched is shiny. Thereafter, the surface is rinsed with deionized water.

The iron material is then dipped into a tank or other container containing the etchant of the present invention. Preferably, the etchant is maintained at a temperature of about 65° C. Typically, the iron material will reside in the etchant for a time period in the range of from about 18 to about 20 minutes. While the iron material is in the etchant solution, the etchant solution may be occasionally agitated such as by a stirring mechanism.

Following etching, the iron material is removed from the etchant tank and rinsed in running deionized water for about five minutes. While being rinsed, any black residue on the surface is removed or scrubbed off using a stiff-bristle brush. The iron material is then preferably blown dry with dry nitrogen and then dried in a 250° F. oven for thirty minutes. The surface is then ready to have a coating material such as an epoxy material bonded to it. If the etched surface is not to be immediately coated with another material, then it should be kept in a dry atmosphere environment.

It has been found that this new etching method aggressively etches iron materials without attacking adjacent epoxy materials or binders. Strength tests which have been performed on iron materials etched in accordance with the present invention indicate that high-strength bonds may be achieved between the etched iron material and a coating material such as an epoxy coating material.

It is apparent that there has been provided in accordance with this invention a surface preparation for bonding iron which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An etchant for etching iron materials comprising an aqueous solution consisting essentially of 20.6 gm $FeCl_2 \cdot 4H_2O$, 88 ml $H_3PO_4$ (concentrated 85%) and deionized water sufficient to make a 500 ml solution total.

2. A method for etching an iron material comprising the steps of:

preparing a surface of the iron material; and etching said surface by immersing said iron material in an aqueous solution consisting essentially of 20.6 gm $FeCl_2 \cdot 4H_2O$, 88 ml $H_3PO_4$ (concentrated 85%) and sufficient deionized water to make 500 ml total.

3. The method of claim 2 wherein:

said iron material is immersed in said aqueous solution for a time period of about 18 to about 20 minutes; and said solution is maintained at a temperature of about 65° C.

4. The method of claim 2 wherein said preparing step comprises degreasing and abrading said surface.

5. The method of claim 2 wherein said preparing step comprises degreasing said surface with isopropyl alcohol and abrading said degreased surface with 80 grit wet abrasive paper.

6. The method of claim 2 further comprising drying said iron material after removing said iron material from said aqueous solution, said drying comprising blow drying said iron material with dry nitrogen and thereafter drying said iron material in an oven.

7. An etchant for etching iron materials in a wound iron core bonded with an epoxy cement without affecting the bonding of the epoxy cement, the etchant comprising an aqueous solution of ferrous chloride and phosphoric acid consisting essentially of 20.6 gm $FeCl_2 \cdot 4H_2O$, 88 ml $H_3PO_4$ (concentrated 85%) and the balance deionized water.

8. A method for etching an iron material comprising the steps of:

preparing a surface of the iron material, said preparation step comprising degreasing and abrading said surface; and etching said surface by immersing said iron material in an aqueous solution of ferrous chloride and phosphoric acid.

9. A method for etching an iron material comprising the steps of:

a first iron surface preparation step comprising degreasing said surface with isopropyl alcohol;

a second iron surface preparation step comprising abrading said degreased surface with 80 grit wet abrasive paper; and etching said surface by immersing said iron material in an aqueous solution of ferrous chloride and phosphoric acid.

10. A method for etching an iron material comprising the steps of:

preparing a surface of the iron material;

etching said surface by immersing said iron material in an aqueous solution of ferrous chloride and phosphoric acid; and drying said iron material after removing said iron material from said aqueous solution, said drying step comprising blow drying said iron material with dry nitrogen and thereafter drying said iron material in an oven.

* * * * *